US005979458A

United States Patent [19]

Meis

[11] Patent Number: 5,979,458

[45] Date of Patent: Nov. 9, 1999

[54] APPARATUS FOR TRANSFERRING LAYERS OF ROD-SHAPED ARTICLES OF THE TOBACCO PROCESSING INDUSTRY

[75] Inventor: Hartmut Meis, Hamburg, Germany

[73] Assignee: Topack Verpackungstechnik GmbH, Schwarzenbek, Germany

[21] Appl. No.: 09/010,360

[22] Filed: Jan. 21, 1998

[30] Foreign Application Priority Data

Jan. 31, 1997 [DE] Germany ..... 197 03 493

[51] Int. Cl.[6] ..... A24C 5/35

[52] U.S. Cl. ..... 131/283; 131/58; 131/105; 131/282; 53/148; 53/149; 53/150; 53/151; 414/796.2; 414/797.9

[58] Field of Search ..... 131/58, 105, 281, 131/282, 283; 198/418.1; 414/796.2, 797.9; 53/148, 149, 150, 151, 236

[56] References Cited

U.S. PATENT DOCUMENTS

| | | | |
|---|---|---|---|
| 2,551,199 | 5/1951 | Bašus . | |
| 4,096,682 | 6/1978 | Sheahan | 53/149 |
| 4,497,872 | 8/1990 | Gamberini . | |
| 4,700,825 | 10/1987 | Mattei et al. | 53/150 |
| 5,611,191 | 3/1997 | Bailey et al. | 131/282 |

FOREIGN PATENT DOCUMENTS

| | | | |
|---|---|---|---|
| 1475759 | 1/1966 | France . | |
| 1192577 | 5/1965 | Germany . | |
| 1295441 | 5/1969 | Germany . | |
| 1908199 | 10/1969 | Germany . | |
| 3312976C2 | 11/1983 | Germany . | |
| 3723407A1 | 1/1988 | Germany . | |
| 3918236A1 | 12/1990 | Germany . | |
| 4100792 | 7/1992 | Germany | 53/148 |
| 4-304875 | 10/1992 | Japan | 131/282 |
| 2097368 | 11/1982 | United Kingdom | 131/282 |
| 2131403 | 6/1984 | United Kingdom | 53/150 |
| 2160514 | 12/1985 | United Kingdom | 53/151 |

*Primary Examiner*—James Derrington
*Assistant Examiner*—Michael P. Colaianni
*Attorney, Agent, or Firm*—Venable; George H. Spencer

[57] ABSTRACT

Discrete cigarettes or layers of parallel cigarettes which are being propelled by a reciprocable pusher from the magazine into successive receptacles of an indexible conveyor in a cigarette packing machine are prevented from moving away from a stationary stop at the station where the receptacles receive discrete cigarettes or layers of cigarettes. This is accomplished by the provision of a stationary or mobile blocking device which does not (or does not appreciably) interfere with the propulsion of cigarettes into a receptacle but invariably prevents a rebounding of cigarettes as a result of impingement upon the stationary stop. The blocking device can be provide with a stationary or a mobile shoulder at the path of cigarettes, or with a lever which can be rocked behind the cigarette or cigarettes in a recepacle and from the path of oncoming fresh cigarette or cigarettes.

19 Claims, 4 Drawing Sheets

2
6
4
8
39
9
22
7
23
17
14
11
21
18
19
13
3
16
12
1

APPARATUS FOR TRANSFERRING LAYERS OF ROD-SHAPED ARTICLES OF THE TOBACCO PROCESSING INDUSTRY

BACKGROUND OF THE INVENTION

The present invention relates to improvements in apparatus for manipulating rod-shaped articles of the tobacco processing industry, and more particularly to improvements in apparatus for advancing discrete articles or groups of two or more parallel articles lengthwise from a first station (such as the bottom portion of a magazine in a cigarette packing machine) to a second station, e.g., into successive receptacles of a conveyor which serves to accumulate arrays of parallel articles preparatory to confinement of such arrays in so-called hinged-lid packets or other types of containers for rod-shaped smokers' products.

It is customary to expel successive layers of plain or filter cigarettes, cigars, cigarillos or other types of rod-shaped smokers' products from the bottom portions of several neighboring upright ducts in the magazine of a packing machine into successive receptacles (e.g., open-ended enclosures having a polygonal cross-sectional outline and defining chambers for the accumulation of arrays of twenty parallel rod-shaped articles) of an endless conveyor which is normally advanced in a stepwise fashion and serves to gather successive arrays of articles and to deliver successive finished (complete) arrays to a wrapping station where the arrays are confined in sheet-like blanks of metallic foil or other types of wrapping material.

The means for expelling layers of articles from the bottom portions of neighboring ducts into successive receptacles of the conveyor normally comprises a flat reciprocable pusher which propels selected numbers of articles from the ducts and into a path wherein the articles advance lengthwise all the way into the receptacle then occupying the receiving station. The receptacles can advance seriatim past three successive magazines to accumulate arrays of articles in the so-called quincunx formation, i.e., a formation which is popular in the United States as well as in many other countries where plain or filter cigarettes are sold in the form of packets containing arrays of twenty cigarettes including two outer layers of seven cigarettes each and an intermediate or median layer of six cigarettes between the two outer layers.

Problems arise in modern high-speed packing machines wherein layers of cigarettes must be expelled from magazines at a very high frequency and must be advanced into the receptacles of an intermittently driven conveyor at an extremely high speed. As a rule, the advancing means (pusher) which propels layers of cigarettes from the bottom portions of ducts in the magazine of a packing machine into successive receptacles (e.g., hollow prismatic boxes) of a stepwise advancing (indexible) conveyor must be accelerated from zero speed to an extremely high speed and its deceleration begins before the layer of articles in front of such pusher reaches its intended ultimate position in the interior of a receptacle. The pusher must be rapidly retracted to permit cigarettes in the ducts of the magazine to descend in front of the retracted pusher before the latter proceeds to carry out a fresh forward stroke.

A layer of cigarettes which are being propelled by a rapidly advancing pusher is not decelerated in response to deceleration of the pusher but continues to advance toward and into the receptacle due to inertia of its constituents. The forward progress of a layer of articles is terminated by a suitable stop which normally causes the articles to rebound and to move backwards, i.e., counter to the direction of advancement with the pusher, so that the articles are likely to come to a halt at different distances from the stop. This is highly undesirable because the axial positions of articles forming an array in the respective receptacle are not predictable and the end portions of certain articles are likely to be defaced and/or otherwise damaged as a result of sidewise movement away from the station in front of a reciprocable pusher. For example, a filter cigarette which has rebounded on impact against a fixed stop at such station is likely to be relieved of its filter mouthpiece during sidewise movement on its way from a first layer receiving station to the next-following station or stations or to a wrapping station.

OBJECTS OF THE INVENTION

An object of the invention is to provide a novel and improved apparatus which is constructed and assembled and which operates in such a way that it is less likely to damage, deface or destroy rod-shaped articles during lengthwise movement than heretofore known apparatus.

Another object of the invention is to provide the above outlined apparatus with novel and improved means for preventing rod-shaped articles from rebounding as a result of impingement upon a stop subsequent to a deceleration of a pusher or other suitable means for propelling discrete articles or groups of two or more parallel articles from a magazine into the receptacles of an indexible conveyor.

A further object of the invention is to provide novel and improved means for arresting freshly propelled rod-shaped articles in optimum axial positions relative to each other and relative to their conveyor.

An additional object of the invention is to provide a novel and improved method of assembling arrays of parallel rod-shaped articles of the tobacco processing industry.

Still another object of the invention is to provide a packing machine embodying one or more apparatus of the above outlined character.

A further object of the invention is to provide an apparatus which can be utilized, with equal facility and reliability, for the manipulation of discrete-rod shaped articles of the tobacco processing industry as well as for the manipulation of layers or other accumulations or groupings of such articles.

Another object of the invention is to provide an apparatus which constitutes a relatively simple but highly advantageous further development of presently known apparatus for assembling arrays of parallel rod-shaped articles of the tobacco processing industry such as plain or filter cigarettes, cheroots, cigars, cigarillos or others.

An additional object of the invention is to provide an apparatus which can accumulate arrays of plain or filter-tipped rod-shaped products of the tobacco processing industry without risking any defacing of and/or other damage to and/or loss of filter mouthpieces during accumulation of a succession of arrays at a high frequency such as is required in modern high-output machines for packing plain or filter cigarettes or other rod-shaped products of the tobacco processing industry.

SUMMARY OF THE INVENTION

The invention is embodied in apparatus for transferring elongated rod-shaped articles of the tobacco processing industry from a first station to a second station along an elongated path extending between the two stations in the longitudinal direction of the articles therein. The improved apparatus comprises means for advancing articles from the first station, along the path and into the second station, and means for blocking movements of articles from the second station, along the aforementioned path, and back toward the first station.

The path can be dimensioned for simultaneous advancement of layers consisting of pluralities of at least substantially parallel coplanar articles from the first station to the second station. The blocking means then preferably comprises means for preventing movements of any one article in a layer of articles from the second station, along the path, and back toward the first station.

For example, the advancing means can comprise a flat substantially plate-like pusher which is reciprocable along the path and has a stroke with a rear end behind the first station and a front end in front of the second station.

The first station can occupy the bottom portion of a magazine for temporary storage of rod-shaped articles of the tobacco processing industry, for example, a magazine in a packing machine for plain or filter cigarettes.

In accordance with a presently preferred embodiment, the second station is or can be defined by any one of a plurality of receptacles forming part of a conveyor which is movable at least substantially transversely of the direction of advancement of articles along the path between the first and second stations. The conveyor can include an endless flexible element (such as one or more chains or one or more belts) for a series of equidistant open-ended receptacles, and such endless flexible element is or can be indexible to locate successive receptacles of the series in a position for reception of articles being advanced along the path from the first station to the second station.

The path can be defined by a guide including a mouthpiece through which the articles advance on their way from the first station to the second station, and the blocking means is or can be located at the mouthpiece. For example, the blocking means can form part of or can be carried by the mouthpiece at a level above and/or below the path wherein the articles advance from the first to the second station.

The apparatus further comprises a stop for the articles arriving at the second station; such stop can constitute a wall which is contacted by the leading ends of the articles upon arrival at the second station, and the blocking means prevents any rebounding or excessive rebounding of articles which strike the stop.

In accordance with one presently preferred embodiment, the guide which defines the path between the first and second stations can include a top surface overlying at least a portion of the path, and a bottom surface which underlies (i.e., is located below) the path. The blocking means can be defined by at least one of the top and bottom surfaces and extends at least substantially transversely of the path. Such blocking means can include a shoulder which is provided in the at least one surface and confronts the second station. The location of the shoulder is or can be selected in such a way that the at least one surface includes a first portion disposed between the shoulder and the first station at a first distance from the other surface, and a second portion disposed between the shoulder and the second station at a greater second distance from the other surface. For example, the shoulder can be provided in the top surface and its plane can be selected in such a way that it is at least substantially normal to the bottom surface. The top and bottom surfaces can be at least substantially horizontal, and the shoulder can be located in a vertical or nearly vertical plane.

If the second station is defined by any one of a plurality of receptacles forming part of the aforementioned indexible conveyor and being movable in a predetermined direction at least substantially transversely of the direction of advancement of articles along the path extending from the first to the second station, the at least one surface of the guide and its shoulder can include portions extending beyond the path in the predetermined direction so that the shoulder constitutes an abutment for the trailing ends of articles being moved by the conveyor from the second station.

In accordance with another presently preferred embodiment, the blocking means includes a pivotable or otherwise movable blocking member and means for pivoting or otherwise moving the blocking member into the path behind the articles arriving at the second station and from the path prior to advancement of the next article or articles along the path from the first to the second station. For example, a pivotable blocking member can include a lever which is pivotable about a predetermined axis into and from the path behind the articles which have just arrived at the second station. The pivoting means can include resilient means arranged to urge the lever in one of two directions (for example, away from the path) and a prime mover (e.g., a fluid-operated motor) which is operable to pivot the lever in the other of the two directions (e.g., into the path against the opposition of the resilient means).

Still further (or in addition to the aforedescribed blocking means), the blocking means can comprise a resilient blocking element which is located in the path between the first and second stations and is arranged to yield to articles being advanced from the first station to the second station but to intercept articles tending to leave the second station in a direction toward the first station. Such resilient blocking element can comprise a shoulder extending transversely of the path, confronting the second station and tending to enter the path, and a ramp which is adjacent the shoulder and extends toward the first station so that an article which advances along the ramp toward the second station temporarily expels (either entirely or in part) the shoulder from the path until such article completes its advancement beyond the shoulder by entering the second station. As used herein, the term, "resilient" is intended to denote a single elastically deformable blocking element, a single partially deformable element, or a combination of two or more elements at least one of which is resilient.

The novel features which are considered as characteristic of the invention are set forth in particular in the appended claims. The improved apparatus itself, however, both as to its construction and its mode of operation, together with numerous additional important and advantageous features thereof, will be best understood upon perusal of the following detailed description of certain presently preferred specific embodiments with reference to the accompanying drawings.

DESCRIPTION OF PREFERRED EMBODIMENTS

Figure 1:
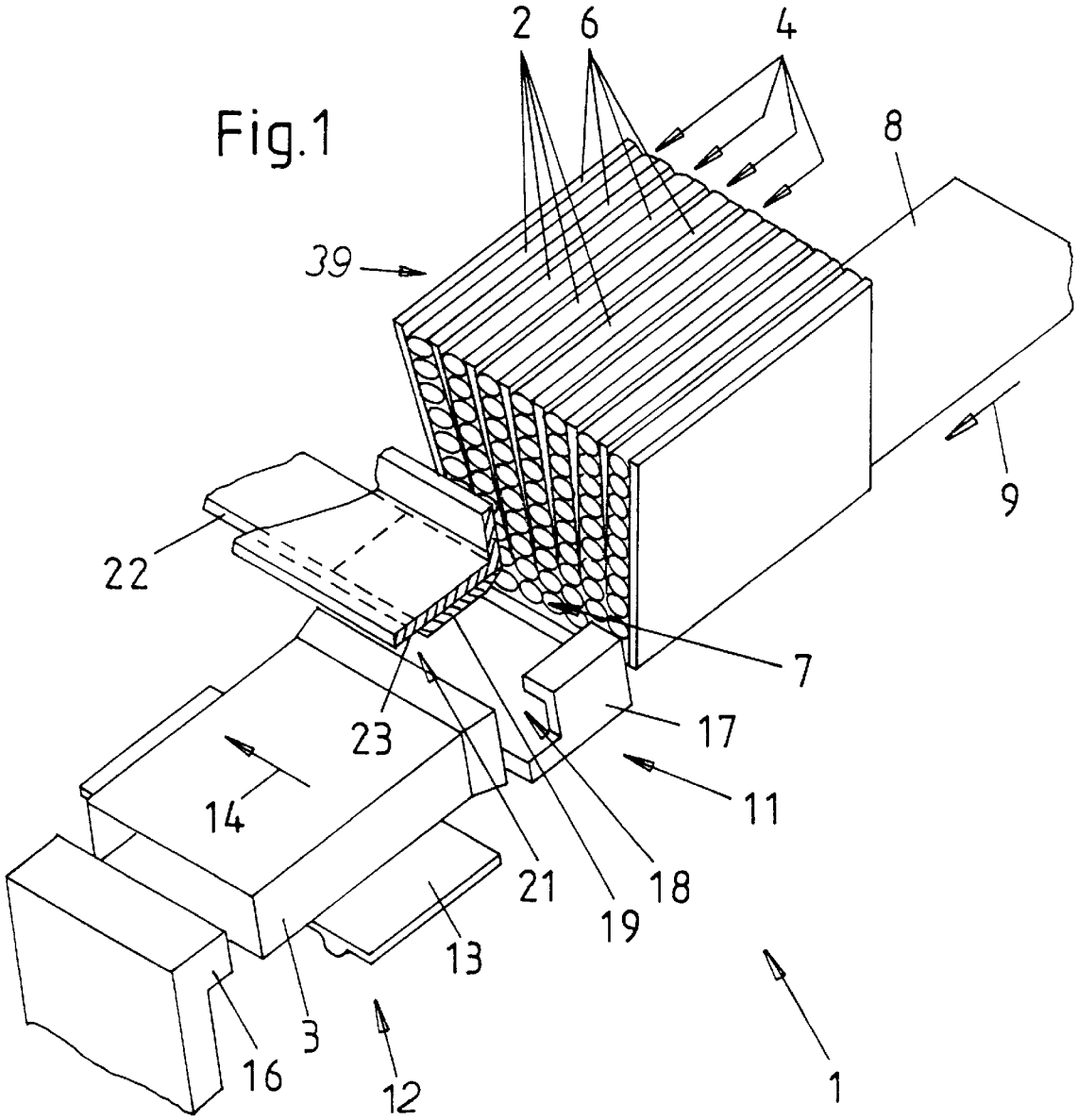
FIG. 1 is a perspective view of an apparatus embodying one form of the invention and employing a stationary blocking device in the form of a shoulder a portion of which is broken away.

FIG. 1 shows an apparatus 1 which is part of a cigarette packing machine. The apparatus serves to transfer successive layers 7 of seven parallel plain cigarettes 2 each from a first station defined by the bottom portion of a magazine 39 of the packing machine to an article receiving second station which is occupied by successive open-ended prismatic receptacles 3 of an indexible conveyor 12 having an endless flexible element 13 (e.g., a chain or a belt) for stepwise advancement of successive receptacles 3 to the second station, for temporary retention of successive receptacles at the second station, and for advancement of partially or completely filled receptacles away from the second station.

The arrow 9 indicates the direction of lengthwise advancement of cigarettes 2 in successive layers 7 from the first station to the second station, and the arrow 14 denotes the direction of stepwise advancement of receptacles 3 to and beyond the second station, namely transversely of the direction of advancement of cigarettes 2 along their path 11.

The cigarettes 2 (or other rod-shaped articles of the tobacco processing industry) which enter the receptacle 3 at the second station can form one stratum of an array of, for example, twenty cigarettes. The other two strata of such array can be introduced into successive receptacles 3 by two additional apparatus (not shown) which follow the apparatus 1 (as seen in the direction of the arrow 14). The first additional apparatus can introduce (second) layers of six parallel cigarettes each on top of the layers introduced at the second station of the illustrated apparatus 1, and the second additional apparatus can introduce (third) layers of seven parallel cigarettes each on top of the respective second layers.

The lower portion of the magazine 39 includes seven upright ducts 4 separated from each other by vertical walls 6 and containing vertical accumulations of superimposed parallel horizontal cigarettes 2. The illustrated horizontal layer 7 contains the cigarettes 2 located at a level beneath the lower ends of the intermediate walls or partitions 6 in front of a reciprocable horizontal plate-like pusher or piston 8 forming part of means for advancing successive layers 7 along the path 11 and into the receptacles 3 then occupying the second station. The means for reciprocating the piston 8 (in and counter to the direction indicated by the arrow 9) can comprise a fluid-operated or electric motor of conventional design.

A stationary abutment or stop 16 is provided at the left-hand open end of the receptacle 3 occupying the second station to limit the extent of advancement of cigarettes 2 in the direction of the arrow 9. It will be seen that the stop 16 is spaced apart from the adjacent open end of the receptacle 3 at the second station, i.e., the front end portions of the cigarettes 2 in a layer 7 extend beyond the respective receptacle 3 when they reach the second station and are arrested by the stop 16. Since the cigarettes are normally propelled at a high speed, they tend to rebound upon impact against the stop 16 and to move counter to the direction indicated by the arrow 9. An important feature of the present invention resides in the provision of a blocking device (21) which prevents the cigarettes 2 from rebounding upon impact against the stop 16 or limits the extent of rebounding to an acceptable (or even desirable) value. The stop 16 can be affixed to or can form part of the frame of the cigarette packing machine which includes the magazine 39.

The path 11 for the advancement of layers 7 from the first station (bottom portion of the magazine 39) to the second station (the space within the receptacle 3 then arrested in and assuming the position shown in FIG. 1) is defined by an elongated guide including a mouthpiece 17 serving to ensure a predictable propulsion of successive layers 7 from the magazine 39 into one of the receptacles 3. The mouthpiece 17 includes an upper wall or roof 19 defining a top surface which overlies the path 11, and a lower wall 18 having a surface which underlies the path 11 and extends at least close to the receptacle 3 at the second station.

The blocking device 21 forms part of the mouthpiece 17 and includes a vertical shoulder 22 provided in the surface of the top wall 19 and extending transversely of the path 11, i.e., in at least substantial parallelism with the direction indicated by the arrow 14. That portion of the surface at the underside of the top wall 19 which is located ahead of the shoulder 22 (i.e., nearer to the magazine 39) is spaced apart from the corresponding portion of the upper side or surface of the bottom wall 18 by a distance which at most equals but can be slightly less than the diameter of a cigarette 2. On the other hand, that portion of the surface at the underside of the top wall 19 which is located downstream of the shoulder 22 (i.e., nearer to the conveyor 12) is spaced apart from the corresponding (confronting) portion of the upper side of the lower wall 18 by a distance which can match or slightly exceed the diameter of a cigarette 2.

FIG. 1 shows that the upper wall 19 includes two panels including a lower panel which defines the shoulder 22 and an upper panel 23 which overlies the lower panel. The shoulder 22 confronts the receptacle 3 at the second station and extends laterally beyond the path 11 in the direction of the arrow 14, i.e., in parallelism with the direction of advancement of receptacles 3, so that it can guide the adjacent end portions of cigarettes 2 in the layers 7 being transported away from the second station, e.g., to a second layer transferring or introducing apparatus or to a wrapping station of the packing machine.

If the distance between the lower and upper walls 18, 19 of the mouthpiece 17 of the guide defining the path 11 is less than the diameter of a cigarette 2, the cigarettes of successive layers 7 are in frictional engagement with (i.e., they are braked by) the walls 18, 19 until their trailing ends advance beyond the shoulder 22 of the blocking device 21. Such friction or braking action ensures that the trailing ends of the cigarettes 2 in a layer 7 advancing along the path 11 remain in contact with the front edge face of the pusher 8 until such trailing ends advance beyond the shoulder 22 and/or until the pusher 8 undergoes a deceleration so that the cigarettes 2 of the layer 7 in the path 11 continue to advance due to inertia and their trailing ends move forwardly and away from the pusher.

Figure 5:
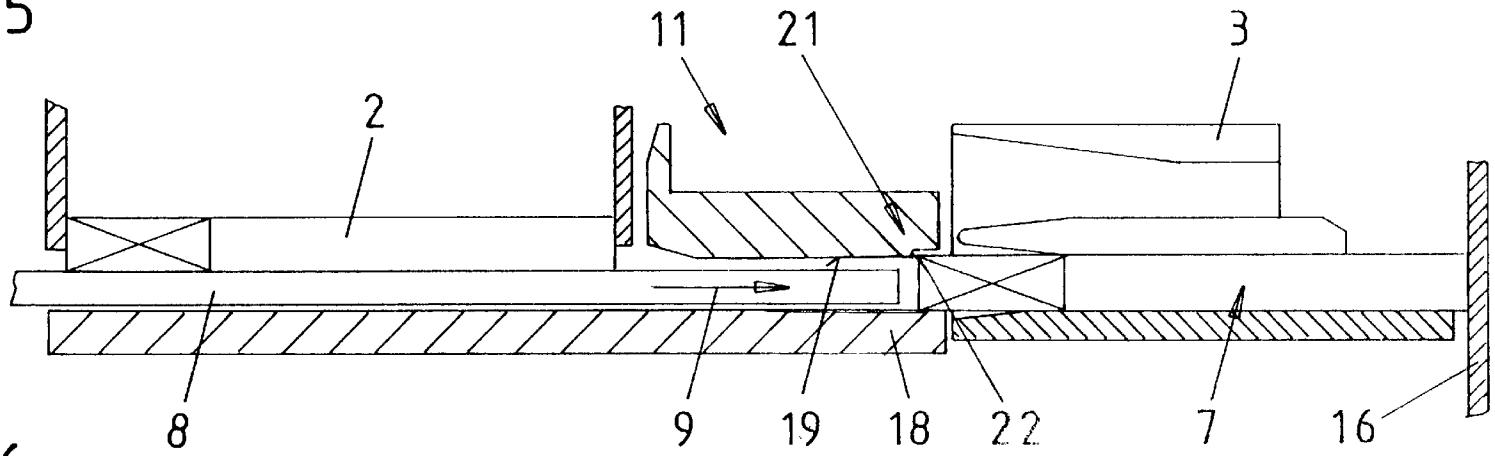
FIG. 5 is a fragmentary longitudinal sectional view of an apparatus which is practically identical with that of FIG. 1 except that it employs a blocking device which is of one piece with the top wall of the mouthpiece, the pusher being shown in its forward end position and the blocking device being ready to intercept articles which tend to rebound upon arrival at the second station.

The apparatus of FIG. 5 is practically identical with the apparatus 1 of FIG. 1. The only important difference is that the top wall 19 of the guide defining the path 11 does not comprise two discrete panels. Moreover, the cigarettes 2 which are shown in FIG. 5 are filter cigarettes having filter plugs at their trailing ends. The right-hand cigarette 2 of FIG. 5 already abuts the stationary stop 16 and the filter plug at its trailing end is slightly spaced apart from the leading edge of the pusher 8 which is about to begin its return stroke. Such return stroke is completed when the leading edge of the pusher 8 is located to the left of the lowermost cigarettes at the first station (in the magazine) so that such lowermost cigarettes come to rest on the upper surface of the lower wall 18 and are ready to be advanced into the next receptacle 3 when the pusher 8 carries out its next forward stroke.

It will be seen that the left-hand end of the underside of the upper wall 19 is provided with a chamfer to ensure predictable entry of a layer of cigarettes 2 into the mouth-piece for advancement (e.g., with at least some friction) toward, past and beyond the shoulder 22 of the blocking device 21. Even a very slight radial expansion of a filter plug which has advanced beyond the shoulder 22 suffices to prevent the respective cigarette 2 from rebounding upon impact against the stop 16, i.e., the left-hand end face of such cigarette is intercepted by the blocking device 21. This ensures that the cigarettes 2 in the receptacle 3 at the second station occupy predetermined axial positions and are not defaced and/or otherwise damaged during sidewise movement (arrow 14 in FIG. 1) toward the next cigarette layer delivering apparatus or to a wrapping station.

The operation of the apparatus 1 of FIG. 1 is as follows:

The pusher 8 is caused to perform alternating forward (arrow 9) and return strokes and advances a fresh layer 7 toward and into an empty or partially filled receptacle 3 at the second station whenever it performs a forward stroke. The surfaces bounding the path 11 confine the cigarettes 2 of each layer 7 to move lengthwise in a prescribed optimum manner, to be braked in the mouth-piece 17 upstream of the shoulder 22, to impinge upon the stop 16, and to be held against any (or against excessive) rebounding by the shoulder 22.

As already mentioned above, at least some frictional engagement between the cigarettes 2 of a layer 7 and the adjacent surfaces of the walls 18, 19 upstream of the shoulder 22 is normally desirable, especially when the pusher 8 is caused to advance toward the stop 16 at a very high speed, because this ensures longer-lasting contact between the front edge face of the pusher and the trailing ends of the cigarettes in the path 11. In other words, the rate of forward movement of cigarettes 2 in each of a short or long series of successive layers 7 is more predictable if such cigarettes remain in contact with the leading edge or front edge face of the pusher 8 for relatively long intervals of time. Such controlled propulsion of cigarettes greatly reduces the risk of damage to the cigarettes on their way (arrow 9) toward impact against the stationary stop 16 and thereupon with the conveyor 12 (arrow 14).

As shown in FIG. 5, the pusher 8 can be decelerated so that the trailing ends of the cigarettes 2 become separated from its leading edge during the last stage of propulsion of cigarettes toward the stop 16. The rebounding (if any) of the cigarettes 2 on impact against the stop 16 is prevented or limited by the shoulder 22 of the blocking device 21. The latter further serves as a means for guiding the adjacent ends of cigarettes 2 in the respective receptacles 3 during advancement with the conveyor 12 in the direction of the arrow 14 so that the cigarettes are less likely to become defaced and/or otherwise damaged (e.g., to be relieved of filter plugs) during subsequent advancement from the second station into the next apparatus or to a wrapping station.

It can happen that the path 11 is blocked while the pusher 8 is in the process of advancing a layer 7 toward the stop 16. For example, a cigarette of a preceding layer 7 can happen to change its orientation and lie against the stop 16. As a rule, the pusher 8 can still complete its forward stroke but the cigarettes of the layer 7 being advanced by the pusher cannot reach the stop 16 so that they undergo a certain amount of deformation (shortening) in the receptacle 3 then occupying the second station. However, the ends of the thus deformed cigarettes 2 tend to expand in the longitudinal direction of the respective cigarettes as soon as they advance beyond the obstruction at the stop 16 or even before if there is some room for axial expansion in a direction toward the shoulder 22. The latter then guides the layer of shortened cigarettes 2 during movement of the layer in the direction of the arrow 14. Thus, the improved blocking device 21 is useful even in the event of a certain deformation of cigarettes 2 in a layer 7 due to the presence of an obstruction or obstacle (foreign object) in the path 11. Cigarettes which are sufficiently defective to warrant segregation of the respective layers from the path for the conveyor 12 can be detected in their receptacles 3 (or upon expulsion from the respective receptacles) by conventional monitoring means not forming part of the present invention.

The rod-like fillers of cigarettes 2 can contain natural tobacco and/or substitute tobacco and/or reconstituted tobacco and filter material for tobacco smoke. Furthermore, the articles 2 can constitute so-called smokeless cigarettes.

Figure 2:
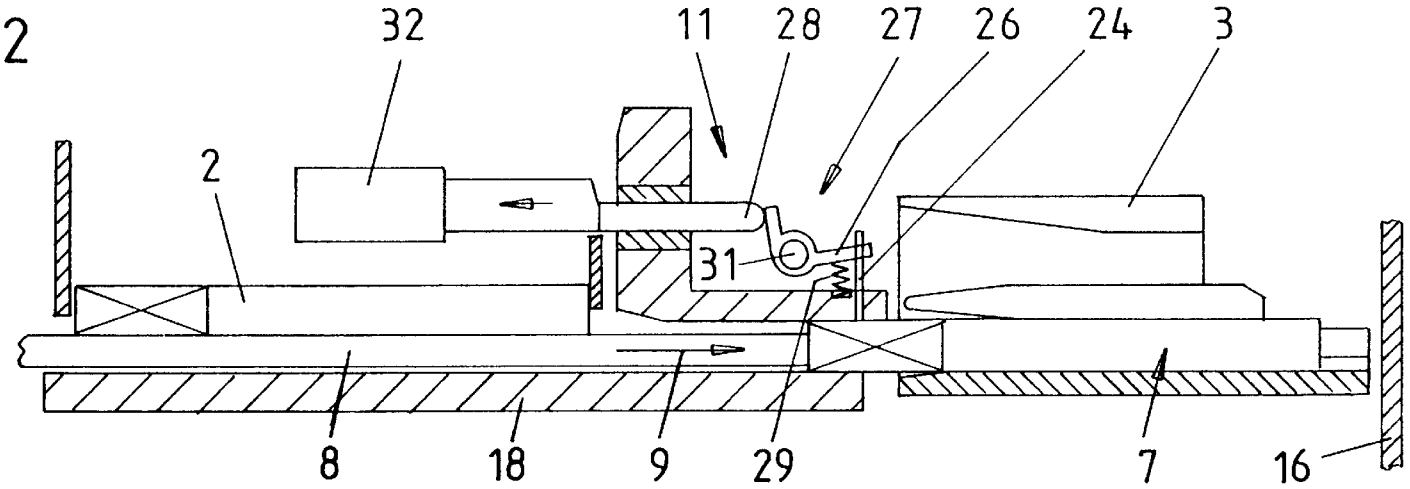
FIG. 2 is a fragmentary longitudinal vertical sectional view of a second apparatus with the pusher shown in the process of advancing one or more articles into the second station and with a pivotable blocking device in the inoperative position.
Figure 3:
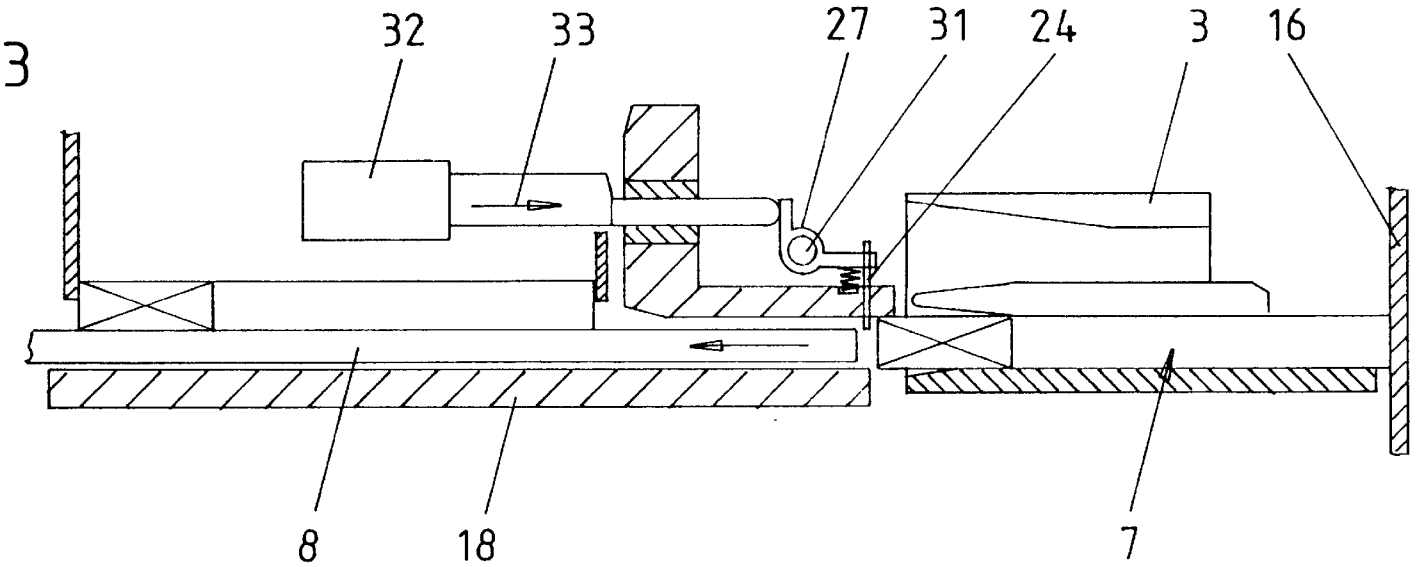
FIG. 3 shows the structure of FIG. 2 but with the pusher on its way to the retracted position and the blocking device in the operative position to prevent or limit the extent of rebounding of articles on impact upon a stationary stop at the second station.

FIGS. 1 and 5 show apparatus with blocking devices 21 in the upper walls 19 of their guide means defining the respective paths 11. FIGS. 2 and 3 show a modified blocking device 27 including a mobile member in the form of a bell crank lever 26 which is pivotable about the horizontal axis of a shaft or pin 31 and one arm of which carries a vertically or nearly vertically reciprocable component 24 in the form of a plate or bolt guided by the upper wall of the guide defining the path 11 for the cigarettes 2 and the pusher 8. The blocking device 27 of FIGS. 2 and 3 further comprises means for pivoting the lever 26 and for thus moving the plate 24 into and from the path 11 in front of the second station (shown as being occupied by a receptacle 3). The means for pivoting comprises at least one resilient element 29 (such as a preferably prestressed coil spring) which tends to expel the plate 24 from the path 11, and a prime mover 32 (e.g., a fluid-operated motor) which can reciprocate an actuating member 28 (e.g., a piston rod) serving to intermittently pivot the lever 26 against the opposition of the spring or springs 29.

The operation of the prime mover 32 is synchronized with that of the means for reciprocating the pusher 8 so that the plate 24 descends into the path 11 behind a layer of cigarettes 2 abutting the stationary stop 16 and in front of the leading edge of the pusher 8 to define a shoulder which limits the extent of rebounding of cigarettes 2 on impact against the stop 16. The spring or springs 29 is or are thereupon free to expel the plate 24 from the path 11 so that the next layer of cigarettes 2 can be advanced from the bottom zone of a magazine into the empty or partly empty receptacle 3 then occupying the second station.

The plate 24 extends all the way across that portion of the path 11 wherein successive single cigarettes 2 or successive layers of two or more parallel cigarettes are being advanced from the first to the second station.

FIG. 2 shows the plate 24 in the fully retracted (raised) position in which the path 11 is unobstructed. In FIG. 3, the plate 24 is shown in its operative position in which it defines a shoulder (corresponding to the shoulder 22) to prevent excessive (or any) rebounding of cigarettes 2 upon impact against the stop 16. In FIG. 2, the pusher 8 is in the process of performing a forward stroke (arrow 9) and its leading edge or front edge face is in contact with the filter plugs of cigarettes 2 advancing toward the stop 16. In FIG. 3, the pusher 8 is about to begin its return stroke, the cigarettes 2 abut the stop 16, and the plate 24 defines a shoulder extending into the path 11 behind the cigarettes 2 in the respective receptacle. As shown in FIG. 3, the exposed lower portion of the plate 24 need not extend all the way to the bottom wall 18.

Figure 4:
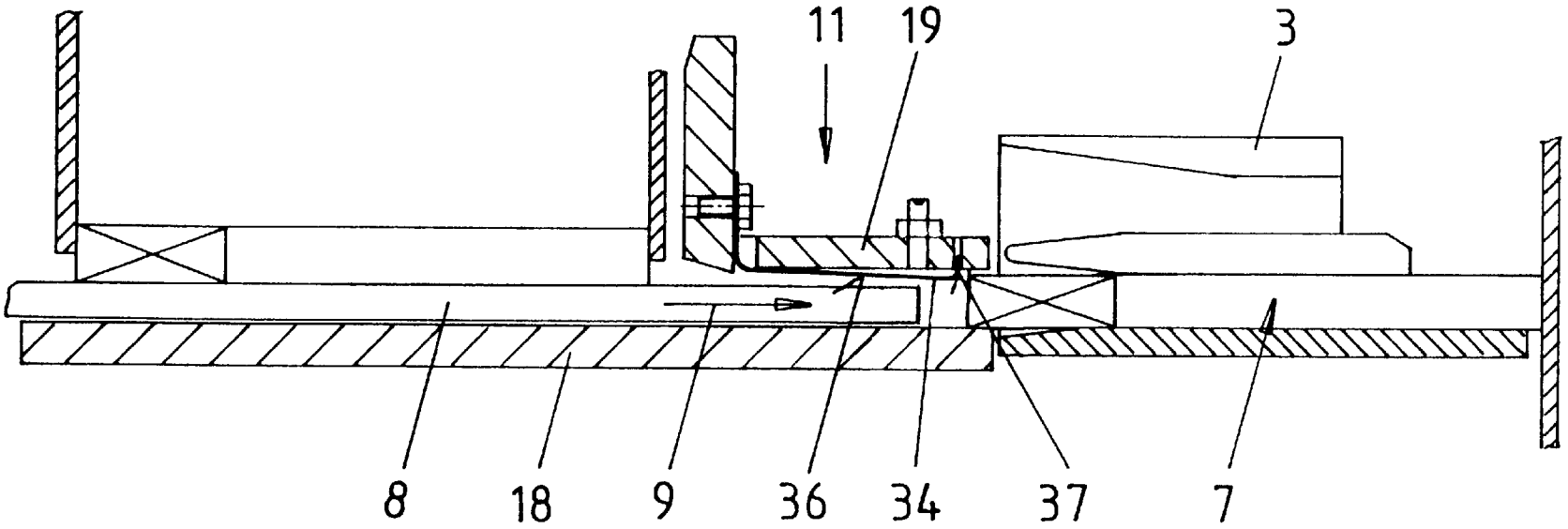
FIG. 4 is a fragmentary longitudinal sectional view of a third apparatus employing a resilient blocking device which is shown in the operative position to prevent any or to prevent excessive rebounding of articles upon arrival at the second station.

FIG. 4 shows an apparatus which constitutes a modification of the apparatus of FIGS. 2 and 3. The mobile (pivotable) blocking device 27 of FIGS. 2–3 is replaced with a mobile blocking device including a resilient blocking element 34 which is normally located in the path 11 and can be expelled (to a necessary extent depending upon the diameters of the cigarettes) from such path by the forward ends of the cigarettes advancing from the first station to the second station (i.e., into a receptacle 3 in front of the top wall 19 of the guide defining the path 11). The blocking element 34 defines a shoulder 37 which normally extends into the path 11 and confronts the second station, and a ramp 36 which normally slopes forwardly and downwardly along the underside of the top wall 19, i.e., into the path of the oncoming cigarettes which are being advanced by the pusher 8 in the direction of the arrow 9. The blocking element 34 (which can be made of resilient metallic or plastic sheet material) is free to dissipate at least some energy as soon as the filter plugs at the trailing ends of a layer 7 of cigarettes advance beyond the shoulder 37. This causes the shoulder 37 to enter the path 11 to an extent which is necessary to prevent any (or excessive) rebounding of cigarettes upon impingement against the stationary stop in front of the receptacle 3 at the second station.

The resilient blocking element 34 performs the desirable additional function of ensuring that the trailing ends of the cigarettes of a layer 7 advancing along the path 11 remain in contact with the front edge face of the pusher 8 at least during a major portion of travel of cigarettes from the first station to the second station.

Figure 6:
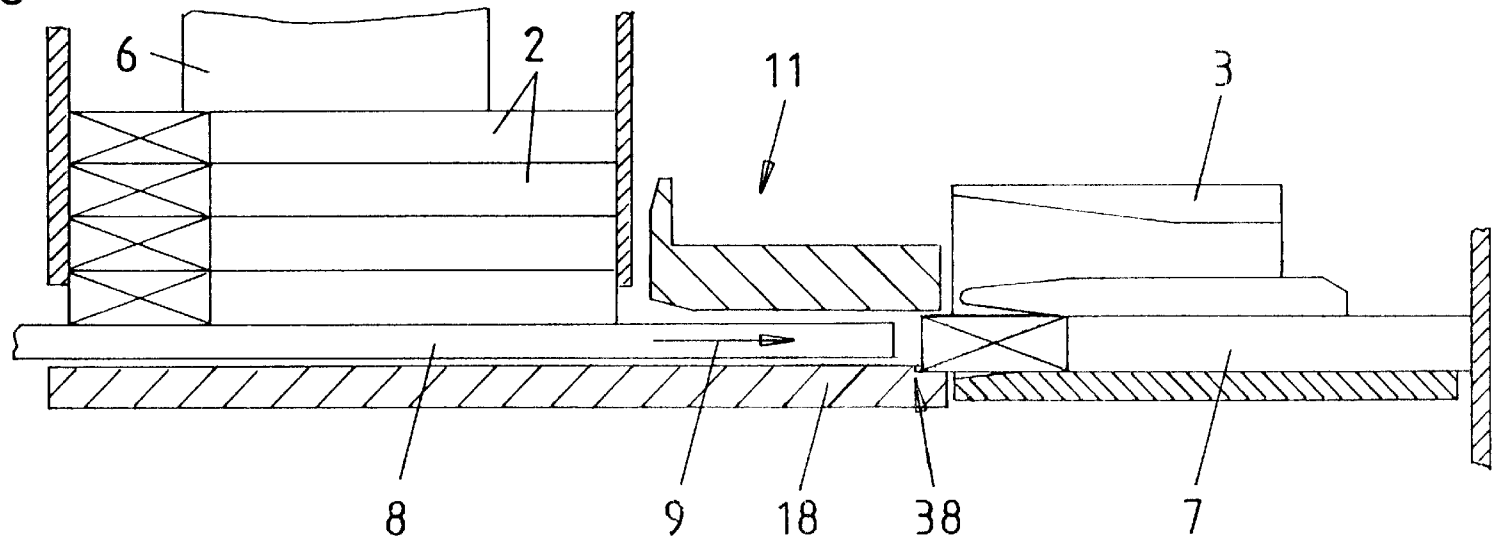
FIG. 6 is a fragmentary longitudinal sectional view of an apparatus which constitutes another modification of those shown in FIGS. 1 and 5.

FIG. 6 illustrates a modification of the apparatus which is shown in FIG. 5. The difference is that the shoulder 38 is provided in the upper side or surface of the bottom wall 18 forming part of the guide means defining the path 11. In all other respects, the apparatus of FIG. 6 is or can be identical with that shown in FIG. 1 or 5.

It will be appreciated that the apparatus of FIG. 5 or 6 can comprise a twin blocking device including, for example, the shoulder 22 or 38 plus a resilient blocking device or element of the type shown (at 34) in FIG. 4. Furthermore, the blocking device 27 of FIGS. 2, 3 and the blocking element 34 of FIG. 4 can be mounted in the bottom wall 18. Still further, and referring for example to FIG. 4, the blocking device can comprise two resilient elements 34, one at the underside of the top wall 19 and the other at the upper side of the bottom wall 18.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of cigarette manipulating apparatus and, therefore, such adaptations should and are intended to be comprehended within the meaning and range of equivalence of the appended claims.

What is claimed is:

1. Apparatus for transferring elongated rod-shaped articles of the tobacco processing industry from a first station against an abutment at a second station along an elongated path extending between said stations in the longitudinal direction of the articles therein, comprising means for propelling articles from said first station, along said path and against said abutment at said second station so that the thus propelled articles impact against and tend to rebound upon impact against said abutment and to move along said path and back toward said first station; and means for blocking rebounding of articles upon impact against said abutment at said second station.

2. The apparatus of claim 1, wherein said path is dimensioned for simultaneous propulsion of layers consisting of pluralities of at least substantially coplanar articles from said first station against said abutment at said second station, said blocking means comprising means for preventing rebounding of any one article in a layer of articles upon impact against said abutment at said second station, along said path and back toward said first station.

3. The apparatus of claim 1, wherein said propelling means comprises a pusher which is reciprocable along said path.

4. The apparatus of claim 1, wherein said first station occupies a bottom portion of a magazine for temporary storage of rod-shaped articles of the tobacco processing industry.

5. The apparatus of claim 4, wherein said magazine forms part of a cigarette packing machine.

6. The apparatus of claim 1, wherein said second station is defined by any one of a plurality of receptacles forming part of a conveyor movable at least substantially transversely of the direction of advancement of articles along said path.

7. The apparatus of claim 6, wherein said conveyor includes an endless flexible element for a series of equidistant receptacles and said endless flexible element is indexible to locate successive receptacles of said series in a position for reception of articles being propelled along said path from said first station to said second station.

8. The apparatus of claim 1, wherein said path is defined by a guide including a mouthpiece through which the articles advance on their way from said first station to said second station.

9. The apparatus of claim 8, wherein said blocking means is located at said mouthpiece.

10. The apparatus of claim 1, wherein said path is defined by a guide including a top surface overlying at least a portion of said path and a bottom surface underlying at least a portion of said path, said blocking means being defined by at least one of said surfaces and extending at least substantially transversely of said path.

11. The apparatus of claim 10, wherein said blocking means includes a shoulder provided in said at least one surface and confronting said second station.

12. The apparatus of claim 11, wherein said at least one surface includes a first portion disposed between said shoulder and said first station at a first distance from the other of said surfaces, and a second portion disposed between said shoulder and said second station at a greater second distance from said other surface.

13. The apparatus of claim 11, wherein said shoulder is provided in said top surface and is at least substantially normal to said bottom surface.

14. The apparatus of claim 11, wherein said surfaces are at least substantially horizontal and said shoulder is at least substantially vertical.

15. The apparatus of claim 11, wherein said second station is defined by any one of a plurality of receptacles forming part of a conveyor movable in a predetermined direction at least substantially transversely of the direction of propulsion of articles along said path, said at least one surface and said shoulder of said at least one surface including portions extending beyond said path in said predetermined direction, said portion of said shoulder constituting a guide for articles being moved by said conveyor from said second station.

16. The apparatus of claim 1, wherein said blocking means includes a pivotable blocking member and means for pivoting said blocking member into said path behind articles arriving at said second station and from said path prior to propulsion of articles along said path from said first to said second station.

17. The apparatus of claim 16, wherein said blocking member includes a lever pivotable about a predetermined axis into and from said path behind articles at said second station, said means for pivoting including resilient means arranged to urge said lever away from said path and a prime mover operable to pivot said lever into said path against the opposition of said resilient means.

18. The apparatus of claim 1, wherein said blocking means includes a resilient blocking element located in said path and arranged to yield to articles being propelled from said first station to said second station but to intercept articles tending to leave said second station in a direction toward said first station.

19. The apparatus of claim 18, wherein said blocking element comprises a shoulder extending transversely of said path, confronting said second station and tending to enter said path, and a ramp adjacent said shoulder and extending toward said first station so that an article being propelled along said ramp toward said second station temporarily expels said shoulder from said path until such article completes its advancement beyond said shoulder by entering said second station.

* * * * *